US005692535A

United States Patent [19]

Walters

[11] Patent Number: 5,692,535

[45] Date of Patent: Dec. 2, 1997

[54] ICING PREVENTER WITH TEMPERATURE ADJUSTMENT WASHER

[76] Inventor: William R. Walters, P.O. Box 594, Cleveland, Okla. 74020-0594

[21] Appl. No.: 759,950

[22] Filed: Dec. 3, 1996

[51] Int. Cl.[6] ..... E03B 7/12

[52] U.S. Cl. ..... 137/62; 60/531; 236/99 R; 237/80

[58] Field of Search ..... 137/59, 62; 60/530, 60/531; 236/99 R; 237/80; 251/11

[56] References Cited

U.S. PATENT DOCUMENTS

| | | | |
|---|---|---|---|
| 956,062 | 4/1910 | Fell | 137/62 |
| 1,268,648 | 6/1918 | Van Meter | 137/62 |
| 1,336,769 | 4/1920 | Welshausen | 137/434 |
| 1,338,469 | 4/1920 | Waage et al. | 137/62 |
| 1,558,276 | 10/1925 | Peterson | 137/62 |
| 1,567,081 | 12/1925 | Robertshaw | 236/102 |
| 2,097,585 | 11/1937 | Carson | 277/20 |
| 2,214,272 | 9/1940 | Dillman | 277/20 |
| 2,283,973 | 5/1942 | Criss | 137/111 |
| 2,573,369 | 10/1951 | Snoddy | 137/139 |
| 2,632,464 | 3/1953 | Kerr | 137/413 |
| 2,833,300 | 5/1958 | Sirotek | 137/244 |
| 2,895,707 | 7/1959 | Bailey | 251/46 |
| 2,938,384 | 5/1960 | Soreng et al. | 73/358 |
| 2,960,303 | 11/1960 | Smallpeice | 251/11 |
| 3,135,287 | 6/1964 | Kepka et al. | 137/414 |
| 3,242,940 | 3/1966 | Sirotek | 137/218 |
| 3,255,775 | 6/1966 | Albro et al. | 137/553 |
| 3,369,556 | 2/1968 | Allderdice | 137/62 |
| 3,574,310 | 4/1971 | Souriau | 137/625 |
| 3,593,917 | 7/1971 | Sebastien | 236/98 |
| 3,690,344 | 9/1972 | Brumm | 137/625.28 |
| 4,016,804 | 4/1977 | Turecek | 92/34 |
| 4,066,090 | 1/1978 | Nakajima et al. | 137/62 |
| 4,072,164 | 2/1978 | Kaden | 137/414 |
| 4,198,029 | 4/1980 | Johnson | 251/61.1 |
| 4,205,698 | 6/1980 | Hucks | 137/62 |
| 4,214,698 | 7/1980 | Josefsson | 236/42 |
| 4,344,450 | 8/1982 | Walters | 137/62 |
| 4,352,371 | 10/1982 | Walters | 137/414 |
| 4,469,118 | 9/1984 | Walters | 137/62 |
| 4,484,594 | 11/1984 | Alderman | 137/62 |

*Primary Examiner*—George L. Walton

*Attorney, Agent, or Firm*—Head, Johnson & Kachigian

[57] ABSTRACT

Apparatus for automatically opening an orifice to allow flow when ambient temperature drops below a predetermined level, such as the freezing point of water. The apparatus is for connection to a liquid line that carries liquid at a selected pressure for producing a selected low flow rate of liquid from the liquid line when the ambient temperature drops below a selected temperature. The apparatus comprises an orifice in the end of the liquid line of selected small diameter, a closed chamber means having an expansible portion filled with a selected condensible gas, for which the vapor pressure varies with temperature in a known manner. The apparatus further comprises a valve assembly selectively positioned adjacent the orifice and at a specific distance from the expansible portion of the closed chamber. The closure means is selectively positioned by means of spacers positioned adjacent the valve assembly. A means connecting the expansible portion of the chamber to a closure means in the valve assembly is provided to shut off the flow of liquid by sealing an orifice when the temperature is above a selected value, and to open the orifice to allow a small trickle flow of liquid whenever the ambient temperature is less than a selected value, such as the freezing point of water.

20 Claims, 2 Drawing Sheets

ICING PREVENTER WITH TEMPERATURE ADJUSTMENT WASHER

BACKGROUND OF THE INVENTION

This invention lies in the field of control valves. More particularly, the invention is concerned with a temperature-sensitive valve that will stop the flow of water from a water line when the outdoor temperature is above a selected temperature, and will start the flow of water when the outdoor temperature is below a selected temperature. The temperature at which the temperature-sensitive valve allows flow can be set by installing a spacer of appropriate width on the valve.

In the prior art, fairly complicated and expensive means have been provided, in many cases involving electrically sensitive temperature sensing means controlling electromagnetic valves, so that when the outdoor temperature becomes less than a selected value, such as approximately 32° F., the valve will open and allow a small trickle of water to flow through the outdoor water line. The resulting motion of the water is sufficient to prevent freezing of water in the water line that is exposed to a cold outdoor temperature. Because of the expense and complications of these various devices, their use is limited and recourse is had to permitting the water flow through the outdoor water line to be continuous throughout the time that the line is unattended, rather than to permit flow only when the temperature is below a selected value.

BRIEF SUMMARY OF THE INVENTION

It is a primary object of this invention to provide a simple mechanical device sensitive to the ambient temperature surrounding the device which will close off the flow of water from an outdoor water pipe when the outdoor temperature is higher than a selected temperature, and will open a small orifice in the line whenever the temperature drops below a selected temperature.

It is a further object of this invention to provide such an apparatus wherein the selection of the shut-off temperature is accomplished by mounting a spacer on the device that has a pre-determined thickness wherein the thickness of the spacer corresponds to a known shut-off temperature for the device.

It is a further object of this invention to provide such an apparatus that is simple, inexpensive, and can operate unattended without difficulty over an extended period of time.

These and other objects are realized and the limitations of the prior art are overcome in this invention by providing a small orifice of elected diameter in the end of the water line, which is outdoors, and is exposed to the outdoor temperature during the season of the year when the temperature may drop below freezing. There is a closure means adjacent to the orifice that can be pressed against the orifice with a selected force, which will shut off the flow of the trickle of water that is otherwise possible through the small orifice.

Motive power for pressing the closure means against the orifice is derived from a thermally sensitive expansion chamber which contains a selected amount of a selected condensible gas, for which the vapor pressure as a function of temperature is well known. The container or chamber is made expansible so that as the vapor pressure inside of the chamber increases, the expansion increases, and the expansible part moves outwardly and presses on the closure means, thus pressing the closure means against the orifice with a force sufficient to stop the flow of water.

Spring means are provided for restraining the movement of the closure means so that only when the force exerted by the expansible portion of the chamber exceeds the force required to compress the spring will the closure means of the valve assembly close off the orifice and stop the flow.

The temperature at which the expansible portion of the chamber acts upon the closure means to close off the orifice and stop the flow can be adjusted by changing the distance of the valve assembly and attached closure means from the expansible portion of the chamber. By moving the valve assembly a greater distance away from the expansible portion of the chamber, the closure means is not forced toward the orifice until a higher temperature is experienced than the temperature necessary to close the orifice if the closure means is positioned nearer to the expansible portion of the chamber. By providing a spacer of a width known to correspond to a desired closure temperature, the flow of water may be controlled to begin at a desired temperature, such as 32° F. Preferably, spacers of different widths will be available so that a user may select a particular closure temperature. In this way, when the ambient temperature drops to a preselected temperature, the vapor pressure of the gas in the chamber will be reduced to the point where a spring will press the closure means away from the orifice. Additionally, the force on the closure means exerted by the water pressure over the small area of the orifice will force the closure means away from the orifice, thereby permitting flow of water through the orifice to a drain. Thus, a small trickle of water flow through the entire water line will be maintained so long as the temperature remains below the selected temperature.

In many fields of industry there are types of operations which involve the use of water and water carrying pipes that are exposed to atmospheric temperature that may, at times, drop below the freezing point. So long as there is flow of water through the pipes in the course of utilization of the water, the problem of freezing is, of course, not important. However, during the hours that operations are shut down, if the temperature in the area adjacent the pipes drops below freezing, there is danger that the water may freeze in one or more portions of the pipes, with consequent difficulties, such as burst pipes, or the need to thaw the pipes, and so on. In such circumstances it may be necessary to leave a trickle of water running through the pipes throughout the night hours when operations are stopped and the lowest temperatures occur, to prevent freezing of water in the pipes. This is a very wasteful type of solution for the problem, since the anticipated low temperature may not occur, or may occur only for a few hours, and therefore the loss of water resulting from the flow through the pipes is a sizeable waste of resource and money.

Consequently, a need exists for a simple automatic mechanical, nonmanual type of apparatus that continuously monitors the environmental temperature. By using the Applicant's device, when the environmental temperature is above a pre-determined level, such as the freezing point of water, the flow of water through the pipe is shut off. However, if at any time the temperature in the vicinity of the pipe falls below the selected temperature, then the device permits a small orifice in the water line to be uncovered. Water is then permitted to flow through the orifice at a selected low flow rate, which should be adequate to maintain a condition in which the water in the water line will not freeze.

BRIEF DESCRIPTION OF THE SEVERAL VIEWS OF THE DRAWING

These and other objects and advantages of this invention and a better understanding of the principles and details of the invention will be evident from the following description taken in conjunction with the appended drawings, in which.

DETAILED DESCRIPTION OF THE INVENTION

Figure 1:
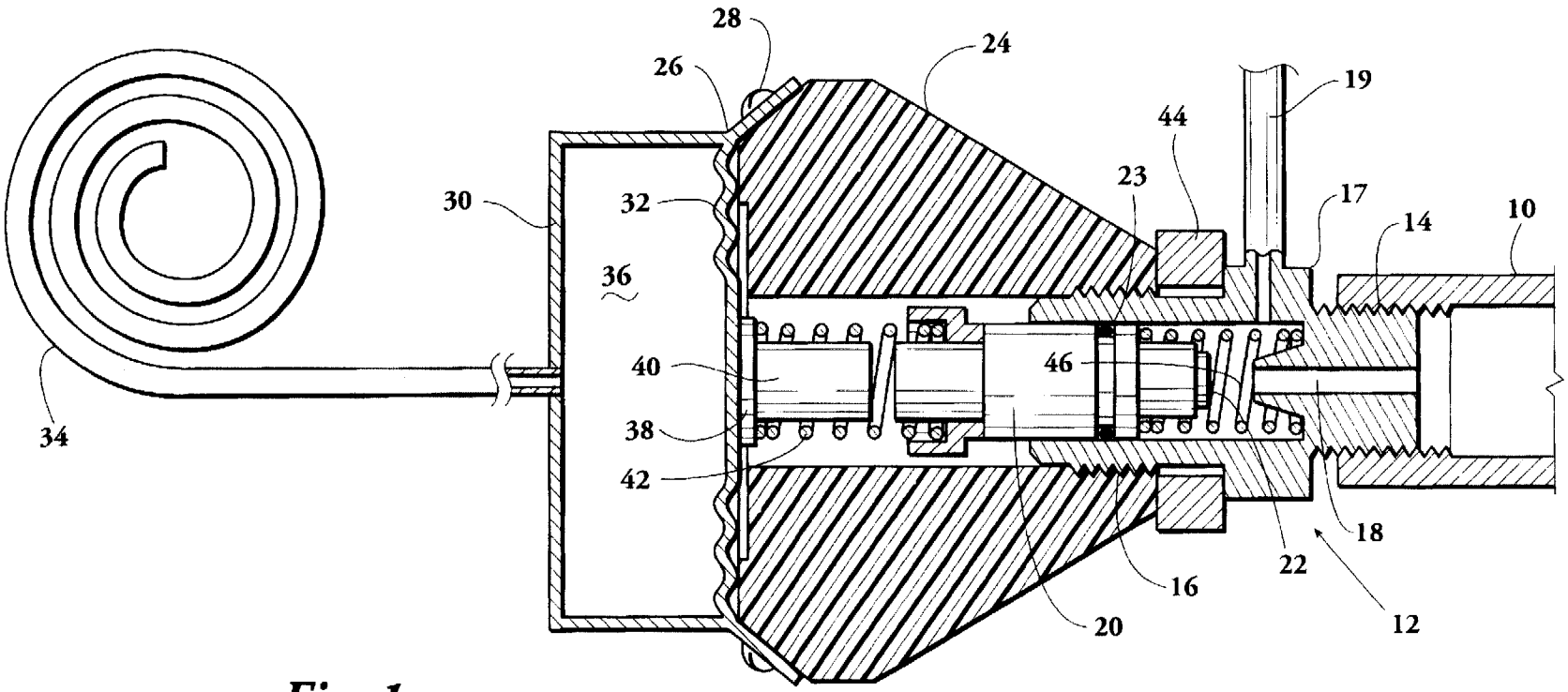
FIG. 1 is a schematic diagram of the invention.

Referring now to the drawing and in particular to FIG. 1 there is shown a schematic diagram of one embodiment of the apparatus of this invention.

Referring now to FIG. 1, the numeral 10 illustrates a portion of the outdoor water line. In an end of water line 10 is a valve assembly, designated generally 12. Valve assembly 12 is comprised of threaded neck portion 14, threaded receptacle 16, flange area 17 and an exit means such as tubular member 19. Threaded neck portion 14 contains an orifice 18 of selected small diameter. Flange area 17 is preferably hexagonal so that valve assembly 12 can be easily removed by means of a wrench. Adjacent to orifice 18 is closure means 20, which preferably carries closure pad 22 of resilient material on its end. The closure means can be coaxial, as shown, and is adapted to be moved longitudinally or axially against orifice 18 to close off flow through orifice 18. A sealing means 23, such as an O-ring, is provided to surround closure means 20 to seal water out of body 24 and retain it in valve assembly 12. Of course, other arrangements of closure means can be used.

Body 24 is provided to house threaded receptacle 16 of valve assembly 12. Attached to body 24 by straps 26, and screws 28, is motor or operating element 30, which comprises a closed chamber, which may be circular and in the form of a shallow pan, covered with flexible diaphragm 32. An axial small tube 34 of considerable length is attached to the chamber through which space 36 inside the chamber can be filled with a selected condensible gas, the vapor pressure of which as a function of temperature is known.

Many such condensible gases are available on the market, each of which have different boiling points and thus different vapor pressures at selected temperatures. A condensible gas should be selected such that the vapor pressure inside of the chamber in space 36 will be able to press outwardly on the flexible diaphragm 32 and exert a force on end plate 38 of piston or biasing means 40. End plate 38 is affixed to piston 40, which presses against closure means 20 to force closure means 20 against orifice 18. Resisting movement of piston 40 is helical spring 42.

To move closure means 20 to close orifice 18, flexible diaphragm 32 must exert a closing force on piston 40. The closing force must be sufficient to overcome the forces acting against it, i.e. the spring force $F_s$, of helical spring 42 and the selected force F. The selected force F is the water pressure exerted against closure pad 22. The selected force F is dependent upon the water pressure over the small area of the orifice, the pressure PI inside of pipe 10 and the diameter of orifice 18. When the vapor pressure of the gas inside space 36 of operating element 30 presses on flexible diaphragm 32 and exerts a force G larger than the spring force $F_s$ and the selected force F, which is exerted on closure pad 22, then flexible diaphragm 32 will move closure means 20 and closure pad 22, thereby sealing off the flow of water through orifice 18.

At any higher temperature, the force G exerted by flexible diaphragm 32 will be still greater and therefore closure pad 22, affixed to closure means 20, will be pressed even more tightly against orifice 18. On the other hand, when the temperature drops, the force G exerted by flexible diaphragm 32 becomes less. The design of the device can be such that when the outdoor temperature in the vicinity of water line 10, and of this device, drops to a selected critical temperature, the force G exerted by flexible diaphragm 32 will be less than the forces exerted by the selected force F and the spring force $F_s$. Closure means 20 will then be pushed away from orifice 18. As a result, water will flow through the orifice at a rate determined by the pressure P1 inside of the pipe 10 and the diameter of orifice 18.

One way to adjust the selected critical temperature at which orifice 18 is left open or is otherwise sealed off by closure pad 22, is to position piston 40 either closer or further from flexible diaphragm 32. The positioning of piston 40 may be adjusted by selectively positioning valve assembly 12 of which piston 40 is a part. Valve assembly 12 may be positioned by inserting spacer 44 between any number of elements of the invention. In the preferred embodiment, valve assembly 12 may be accurately positioned by inserting spacer 44 between body 24 and flange area 17. Spacing means 44 is preferably in the form of a washer. Spacing means 44 is preferably provided in a variety of widths, wherein each width corresponds to a known temperature of closure. Increased spacing of closure means 20 away from flexible diaphragm 32 raises the temperature of closure. Conversely, decreased spacing of the closure means away from diaphragm 28 lowers the temperature of closure.

In the preferred embodiment, small helical spring 46 of thin wire is utilized simply to push closure means 20 away from orifice 18 and to prevent oscillation of closure means 20 when the pressure G exerted by flexible diaphragm 32 of thermal motor 30 is insufficient to close off orifice 18. On the other hand, when the pressure G of flexible diaphragm 32 becomes great enough, it can easily overcome the additional spring force of the small helical spring 46 and close off orifice 18.

Figure 2:
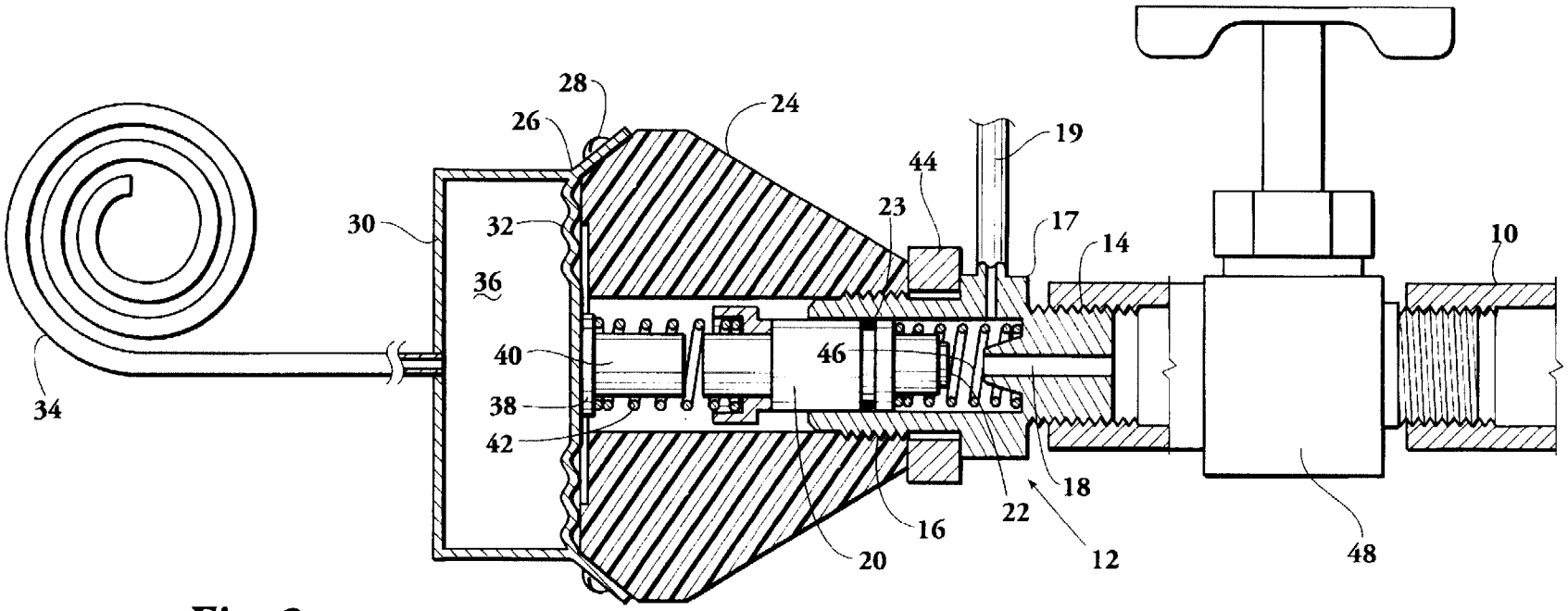
FIG. 2 is a view of a second embodiment of the invention.

In FIG. 2, a similar device is shown with the addition of a flow adjusting means, such as valve 48, which may conveniently be of the form of a needle valve, so that by adjusting valve 48, the rate of flow through orifice 18 can be any selected value, thus altering the rate of flow of water from orifice 18 when valve 48 is opened.

By providing such a system, whenever the temperature drops below a critical level, for example below 32° F., the force G exerted by flexible diaphragm 32 will be insufficient to overcome the spring force $F_s$ of helical spring 42 and selected force F, exerted by water pressure over orifice 18. As a result, water is able to flow out orifice 18 at a rate determined by the setting of valve 48. The water then may exit through tubular member 19. The resulting flow therefore takes place through the full length of pipe 10 so that freezing will be prevented throughout the length of pipe.

In practice, a user may wish to set the device to open at a particular critical temperature. The set point may be selected simply by replacing spacing means 44 with a spacing means of different width. Preferably, various spacing means will be provided, each of which will correspond to a known critical temperature.

It is seen therefore that other embodiments are possible which use this same principle by means of which a thermal motor continuously monitors the temperature, and which opens a closure means at a selected critical temperature, to uncover a small orifice, and to permit the selected flow rate of water to trickle through the water pipe, so as to prevent freezing inside of the pipe. It is also seen that by spacing the closure means at a selected distance from the thermal motor, specific desired temperatures of closure can be obtained.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element of step thereof is entitled.

What is claimed is:

1. Apparatus for connection to a water line carrying water at a selected pressure, for producing a selected low flow rate of water from said line when ambient temperature drops below a selected temperature, comprising:

a) a valve assembly having a neck portion, a receptacle portion, a flange area, and an exit means, said neck portion for engaging the water line, said neck portion defining an orifice of selected diameter;

b) a body having a housing, said housing having a first end and a second end, said housing first end for receiving said receptacle portion of said valve assembly;

c) a motor comprised of a closed chamber, said closed chamber having an expansible portion, said chamber filled with a selected condensible gas for which the vapor pressure varies with temperature in a known manner, said motor affixed to said body, said expansible portion engaging said second end of said housing;

d) a closure means proximate said receptacle portion of said valve assembly, said closure means having a biasing means for engaging said expansible portion of said motor, said closure means for engaging said orifice, said expansible portion for pushing against said biasing means when ambient temperature is above a selected temperature, thereby resulting in said closure means engaging said orifice, said biasing means disposed between said closure means and said motor for aiding in the closing of said closure means; and e) a spacing means of various selected widths positioned at least between a portion of a selected two of said valve assembly, said body, said motor, said closure means and said biasing means, for positioning said closure means at various selected distances from said expansible portion, thereby said various selected spacing means corresponds to various selected closing temperatures whereupon said closure means engages against said orifice.

2. The apparatus according to claim 1, wherein said width of said spacing means corresponds to a known selected temperature whereupon said closure means engages said orifice.

3. The apparatus of claim 2, wherein said spacing means is positioned between said flange area of said valve assembly and said body.

4. The apparatus of claim 3, wherein said spacing means is a washer.

5. The apparatus of claim 4, wherein said washer is comprised of plastic.

6. The apparatus according to claim 1, wherein said spacing means is positioned between said flange area of said valve assembly and said body.

7. The apparatus of claim 6, wherein said spacing means is a washer.

8. The apparatus of claim 7, wherein said washer is comprised of plastic.

9. The apparatus of claim 1, wherein said spacing means is a washer.

10. The apparatus of claim 9, wherein said washer is comprised of plastic.

11. Apparatus for connection to a liquid line, the apparatus for producing a flow of liquid from said liquid line when ambient temperature drops below a selected temperature, the apparatus comprising:

a) a valve assembly, having a neck portion, a receptacle portion, a flange area, and an exit means, said neck portion for engaging the liquid line, said neck portion defining an orifice;

b) a body having a housing, said housing having a first end and a second end, said housing first end for receiving said receptacle portion of said valve assembly;

c) a motor comprised of a closed chamber, said closed chamber having an expansible portion, said chamber filled with a selected condensible gas for which the vapor pressure varies with temperature in a known manner, said motor affixed to said body, said expansible portion engaging said second end of said housing;

d) a closure means proximate said receptacle portion of said valve assembly, said closure means having a biasing means for engaging said expansible portion of said motor, said closure means for engaging said orifice, said expansible portion for pushing against said biasing means when ambient temperature is above a selected temperature, thereby resulting in said closure means engaging said orifice, said biasing means disposed between said closure means and said motor for aiding in the closing of said closure means;

e) a spacing means of various selected widths positioned at least between a portion of a selected two of said valve assembly, said body, said motor, said closure means and said biasing means for positioning said closure means at various selected distances from said expansible portion, said various selected spacing means corresponding to various known selected closing temperature whereupon said closure means engages said orifice, said spacing means for adjusting said selected temperature whereupon said closure means engages said orifice; and f) a valve positioned in the liquid line for regulating the flow of liquid from said apparatus.

12. The apparatus of claim 11, wherein said width of said spacing means corresponds to a known selected temperature whereupon said closure means engages said orifice.

13. The apparatus of claim 12, wherein said spacing means is positioned between said flange area of said valve assembly and said body.

14. The apparatus of claim 13, wherein said spacing means is a washer.

15. The apparatus of claim 14, wherein said washer is comprised of plastic.

16. The apparatus of claim 11, wherein said spacing means is positioned between said flange area of said valve assembly and said body.

17. The apparatus of claim 16, wherein said spacing means is a washer.

18. The apparatus of claim 17, wherein said washer is comprised of plastic.

19. The apparatus of claim 11, wherein said spacing means is a washer.

20. The apparatus of claim 19, wherein said washer is comprised of plastic.

* * * * *

UNITED STATES PATENT AND TRADEMARK OFFICE

CERTIFICATE OF CORRECTION

PATENT NO. : 5,692,535
DATED : December 2, 1997
INVENTOR(S) : William R. Walters It is certified that error appears in the above-identified patent and that said Letters Patent is hereby corrected as shown below:

Col. 3, line 55, delete "PI" and substitute --P1-- therefor; and

Column 6, line 39, delete "perature" and substitute --peratures-- therefor.

Signed and Sealed this

Tenth Day of March, 1998

Bruce Lehman

*Attest:*

BRUCE LEHMAN

*Attesting Officer*

*Commissioner of Patents and Trademarks*